US008453360B2

(12) United States Patent
Wielstra

(10) Patent No.: US 8,453,360 B2
(45) Date of Patent: Jun. 4, 2013

(54) STEAM GENERATING DEVICE PROVIDED WITH A HYDROPHILIC COATING

(75) Inventor: Ytsen Wielstra, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 367 days.

(21) Appl. No.: 12/681,117

(22) PCT Filed: Sep. 26, 2008

(86) PCT No.: PCT/IB2008/053929

§ 371 (c)(1), (2), (4) Date: Apr. 1, 2010

(87) PCT Pub. No.: WO2009/044320

PCT Pub. Date: Apr. 9, 2009

(65) Prior Publication Data

US 2010/0242316 A1 Sep. 30, 2010

(30) Foreign Application Priority Data

Oct. 5, 2007 (EP) ..... 07117930

(51) Int. Cl.
*D06F 75/18* (2006.01)
*D06F 75/24* (2006.01)

(52) U.S. Cl.
USPC ..... 38/77.83

(58) Field of Classification Search
USPC ..... 38/74–77.9; 427/318
See application file for complete search history.

(56) References Cited

U.S. PATENT DOCUMENTS

| | | | | |
|---|---|---|---|---|
| 2,333,206 | A * | 11/1943 | Sloan | 428/623 |
| 2,683,320 | A | 7/1954 | Morton | |
| 2,792,652 | A * | 5/1957 | Dawson | 38/82 |
| 3,218,741 | A | 11/1965 | Martin | |
| 3,499,237 | A | 3/1970 | Piper | |
| 3,551,183 | A * | 12/1970 | Vondracek et al. | 427/318 |
| 3,989,550 | A * | 11/1976 | Newhard | 148/256 |
| 5,060,406 | A | 10/1991 | Verweij et al. | |
| 5,592,764 | A * | 1/1997 | Boulud et al. | 38/77.83 |
| 6,638,600 | B2 * | 10/2003 | Gazo et al. | 428/141 |
| 7,008,916 | B2 * | 3/2006 | Carswell et al. | 510/475 |

FOREIGN PATENT DOCUMENTS

| | | | |
|---|---|---|---|
| EP | 0425043 | A1 | 5/1991 |
| EP | 1572813 | B1 | 8/2006 |
| FR | 2707732 | A1 | 1/1995 |
| FR | 2806427 | A1 | 9/2001 |
| WO | 2004096539 | A1 | 11/2004 |

* cited by examiner

*Primary Examiner* — Ismael Izaguirre

(57) ABSTRACT

A steam generating device includes a steam chamber provided with a hydrophilic coating. The hydrophilic coating includes an alkali metal silicate compound and boron, preferably a salt of boron with a metallic element. The coating promotes steaming and is resistant to flaking.

13 Claims, 1 Drawing Sheet

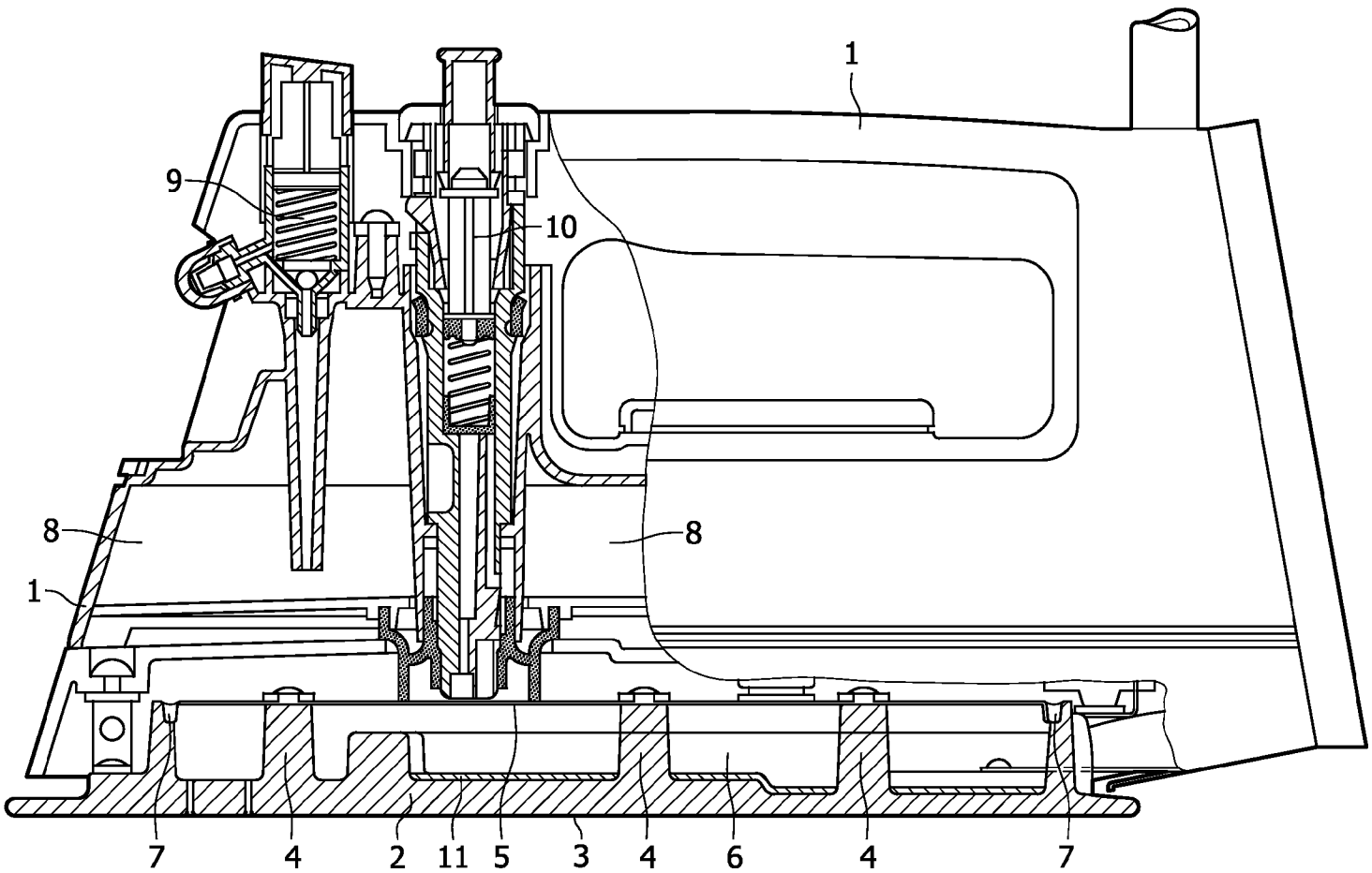
1
10
9
8
8
1
7
4
6
4
3
5
11
2
4
7

STEAM GENERATING DEVICE PROVIDED WITH A HYDROPHILIC COATING

FIELD OF THE INVENTION

The invention relates to a steam generating device comprising a steam chamber provided with a hydrophilic coating. The invention further relates to a method of providing a hydrophilic coating in the steam chamber of a steam generating device. The invention in particular relates to a steam iron comprising a steam chamber provided with a hydrophilic coating.

BACKGROUND OF THE INVENTION

Heating water above 100° C. at 1 atmosphere will transform it into steam. In steam generating devices, such as steam irons, water is applied to a hot surface in order to generate the steam. However, the steam can form an insulating layer between the surface and the water droplets, thereby effectively slowing down the evaporation of water. The water droplets will tend to bounce on the surface instead of evaporating into steam. This effect is called the Leidenfrost effect and generally occurs above 160° C. This effect is for instance observed in steam irons.

Various methods have been proposed to prevent the Leidenfrost effect, ranging from providing special structures in the steam chamber, like ribs for instance, to the use of coatings on the surface of the steam chamber. A suitable steam promoter coating is hydrophilic and moderately heat-insulating. The moderately heat-insulating character of the coating slightly lowers the surface temperature in the absence of water and prevents the water from touching the hot aluminum substrate. When some water touches the surface, the surface is immediately cooled down effectively to below Leidenfrost effect temperatures. Preferably also, such steam promoter coatings do have a certain amount of porosity. By virtue of the hydrophilic character of the steam promoter coating, the water introduced spreads readily over the surface of the steam chamber. A suitable steam promoter coating offers a combination of good wetting, absorption of water into the porous structure, and a high surface roughness.

A steam generating device of the type described in the preamble is known from U.S. Pat. No. 3,499,237. The known device (a steam iron) is provided with a steam promoter coating composition, mainly composed of an alkali metal silicate compound and powdered glass. In particular sodium silicate (water glass) is used. Water glass can be dried to form a hard glassy layer. Due to its inorganic nature it is temperature resistant and can be used as a steam promoter coating in a steam iron. Due to its high pH, water glass etches the aluminum soleplate substrate, thereby improving the adhesion of the coating layer to the aluminum. A major drawback of water glass is its solubility in water, the reason being the high amount of alkali present in water glass. As soon as water is added to the steam chamber of a steam iron, the known steam promoter material will at least partly dissolve, and may leach out of the steam chamber. This effect is even more pronounced when the steam chamber is decalcified by rinsing it with water.

SUMMARY OF THE INVENTION

It is an object of the present invention to overcome the above-mentioned problems. In particular, it is an object of the present invention to provide a steam generating device with a steam chamber provided with a hydrophilic coating with decreased solubility in a warm and humid environment. A further object is to provide a steam chamber coating which is less sensitive to the Leidenfrost effect. A further object is to provide a method of applying a hydrophilic coating composition in the steam chamber of a steam iron in order to promote steaming.

These and other objects are achieved by means of a steam generating device comprising a steam chamber provided with a hydrophilic coating comprising an alkali metal silicate compound, wherein the coating further comprises boron. Preferably, a steam generating device is provided, comprising a steam chamber provided with a hydrophilic coating comprising an alkali metal silicate compound, wherein the coating further comprises a salt of boron, even more preferred of boric acid, with a metallic element.

BRIEF DESCRIPTION OF THE DRAWINGS

In the drawing:

FIG. 1 is a view partly in cross-section and partly in elevation of a steam iron according to the invention.

DETAILED DESCRIPTION OF EMBODIMENTS

According to the invention, a steam generating device is provided, which device comprises a steam chamber provided with a hydrophilic coating. The hydrophilic coating composition comprises an alkali metal silicate compound, as well as boron, preferably a salt of boron with a metallic element. The combined use of an alkali metal silicate compound and a salt of boron with a metallic element yields a coating, after curing, with an excellent steaming performance. In particular, the invented coating shows most of the desirable features of a steam promoter coating: it not only shifts the Leidenfrost effect to higher temperatures, shows good wetting behavior and water spreading into the porous structure thereof, but it also prevents or at least diminishes thermal insulation and flaking of the coating. A further advantage of the coating composition according to the invention is that it is easily sprayable.

Surprisingly, it has been found that the addition of boron, preferably a borate, to the water glass, and to an alkali metal silicate in general, lowers the solubility thereof. It is believed that a reaction of the borate with the alkali is (partly) responsible for this beneficial effect. Mixing borate with an alkali metal silicate, and with water glass in particular, at a certain ratio of Si:B:alkali provides compositions that are still soluble in water after mixing, but become insoluble after drying. It seems that adding borate has effectively decreased the solubility of the alkali metal silicate after drying, presumably by reacting with (part of) the alkali. The resulting alkali borosilicate coating shows good adhesion to an aluminum substrate, is substantially insoluble in water, and moreover may provide a good steaming performance. It is known that borate can exist in different structures e.g. as diborate, metaborate, pyroborate, etc. The present invention however is not limited to any of these structures. For convenience, borate may be added to the alkali metal silicate in the form of boric acid and/or as a salt of boric acid with an alkali metal element. It is also possible to use borate esters, such as $B(OCH_3)_3$ for instance.

In a preferred embodiment of the invention, the steam generating device is characterized in that the metallic element is an alkali metal element. Any alkali metal element may in principle be used, but preferred elements are chosen from the group of sodium, lithium and potassium. The use of lithium is particularly preferred if the stability of the steam promoter coating composition has to be improved. The use of potassium is preferred if the steaming performance of the steam promoter coating has to be improved.

In order to produce a favorable effect, the quantity of borate in the steam promoter coating composition is preferably between 1 and 40% by weight of the total composition of the dried coating (the water in the coating composition is substantially removed). More preferably, the quantity of borate is between 5 and 30% by weight, most preferably between 8 and 20% by weight.

The mechanical properties and in particular the strength of the coating can be improved by adding fillers thereto. Any filler known in the art may be employed, including metal oxide particles, such as alumina and silica, mineral particles like mica, kaolin, etc., or mixtures thereof. In a further preferred embodiment of the invention, the hydrophilic coating of the steam generating device comprises silica particles. These particles are believed to yield better coatings, possibly due to the fact that they take away some of the alkaline fraction of the coating, e.g the Si/alkali ratio is enhanced, reducing further the solubility of the final material. Colloidal silica (for instance from Ludox (Degussa)) can be used but more preferably coarser silicas are applied. Examples are fumed silicas (e.g. Aerosil, (Degussa)) or precipitated silicas (Sipernat (Degussa)).

In order to produce coatings with improved mechanical properties, the quantity of filler in the steam promoter coating composition is preferably between 5 and 60% by weight of the total composition of the dried coating (the term dried means that the water in the coating composition is substantially removed). More preferably, the quantity of filler is between 10 and 40% by weight, most preferably between 15 and 25% by weight.

The invention also relates to a method of producing a hydrophilic coating in the steam chamber of a steam generating device. The method comprises preparing a mixture of an alkali metal silicate compound and a salt of boron with a metallic element, introducing the mixture into the steam chamber and curing the mixture at elevated temperature to form a hydrophilic coating. Introducing the mixture into the steam chamber is preferably carried out by spraying.

In particular, the method is characterized in that boron, preferably boric acid, is dissolved in water, to which an alkali metal hydroxide is added. Suitable metal hydroxides are sodium hydroxide, lithium hydroxide and potassium hydroxide, potassium hydroxide being the most preferred alkaline compound. This solution is then stirred into a solution of an alkali metal silicate compound. The resulting (translucent) solution, usually having an increased viscosity, is then applied to the aluminum substrate and cured at elevated temperature into a hydrophilic coating. A substantially insoluble, porous borosilicate coating is obtained. The obtained coating promotes the formation of steam, without the occurrence of flaking and/or other disadvantageous effects.

An additional advantage of the coating according to the invention is that suitable coatings can be obtained within a wide range of thicknesses. Due to the favorable rheology of the coating composition of the invention, and in particular its relatively low viscosity, rather thin coatings can readily be applied. The coating layer thickness can thus be tuned, depending on the specific type of steam promoter material used. Thick non-porous coating layers will prevent the Leidenfrost effect up to high temperatures. However, if the layer is too thick, the thermal conduction through the layer limits the evaporation rate too much. Especially at lower temperatures and high water dosing rates, water can leak out of the steam generating device. If the coating layer is too thin, the evaporation rates at low temperatures are higher. However, the steam generating device will in this case be more prone to the Leidenfrost effect, and water touching the surface can bounce off, leading to spitting of the steam generating device at high temperatures. For porous coating layers, high evaporation rates both at low temperatures (due to better spreading), and at high temperatures can be achieved. The layer thickness moreover may be limited by the mechanical properties of the coating material. Flaking may occur if coating layers exceed a certain critical thickness. Generally speaking, preferable coating layer thicknesses vary between 1 and 100 micron, more preferably between 20 and 80 micron, and most preferably between 30 and 60 micron.

To improve the adhesion between the coating and the aluminum substrate, the aluminum can be cleaned by rinsing with organic solvent, and/or by mechanical means, such as sandblasting. Wetting of the aluminum surface can also be improved by adding surfactants to the coating mixture.

Curing of the coating composition is performed at elevated temperature, the specific curing (or drying) temperature being dependent on the composition of the coating. The uncured coating composition can be brought to the curing temperature by heating in an oven, or by any other heating source, such as infrared, ultrasonic, etc. The preferred method of curing however comprises heating the steam chamber surface itself. In this way the coating is cured from the inside to the outside surface thereof, which has a beneficial effect on the properties of the produced coating. The inside surface is the surface closest to the aluminum substrate, the outside surface being the surface most remote from the aluminum substrate. Too fast drying/curing of the coating composition may result in boiling marks in the cured coating. It therefore is optional to preheat the steam chamber surface before application of the coating composition.

The invention will now be explained in greater detail by means of the enclosed figure, and by means of the following examples, without however being limited thereto.

The steam iron shown in FIG. 1 is composed of a housing 1 which is closed on the bottom side by an aluminum soleplate 2, which is provided with a thin layer of stainless steel on the underside 3. The soleplate is provided with upright ribs 4 on the inside, on which ribs an aluminum plate 5 is provided in such a manner that a steam chamber 6 is formed between the inside of the soleplate 2 and the plate 5. The steam chamber 6 is sealed by an elastic silicone rubber 7. The steam iron further comprises a water reservoir 8. By means of a pumping mechanism 9, water from the reservoir 8 can be sprayed directly onto the clothes to be ironed. By means of a pumping mechanism 10, water can be pumped from the reservoir 8 into the steam chamber 6, thus increasing the steam output. This water passes through an aperture in plate 5 to the bottom of the steam chamber 6. The bottom of the steam chamber 6 is provided with a hydrophilic steam chamber coating 11. The hydrophilic coating 11 is manufactured and provided as will be described in the following examples.

In all examples an aqueous suspension was made of the indicated ingredients by simple mixing. The suspensions thus obtained were subsequently applied to the bottom of the steam chamber 6 and then thickened by means of drying and/or curing. In this manner a hydrophilic steam chamber coating 11 (FIG. 1) is obtained.

EXAMPLE I

Influence of the Amount of Borate

In this set of experiments, the influence of the borate amount on the solubility of the cured coating was analysed.

Varying amounts of boric acid were used, as indicated in Table 1. An amount of 20 grams of water glass (Aldrich) was mixed with 0.5, 1, 1.5 and 2 grams of boric acid and additional water to dissolve the boric acid. In the case of addition of 2 grams of boric acid, some precipitate formed which did not dissolve even when 55 grams of water was added. The resulting material was applied onto an aluminum soleplate and cured at 220° C. After curing for 2 minutes water was dripped onto the heated material for a short time. The integrity of the coating was observed visually. With no boric acid added, the water-glass layer dissolved. With an increasing amount of boric acid the solubility diminished. Around a ratio of Si:B of 2.8 to 1 the coating layer had become insoluble.

TABLE 1

| Prepared solutions and results | | | | | | |
|---|---|---|---|---|---|---|
| Water glass | boric acid | Water | Si | Na | B | Dissolution |
| 20 gram | 0 gram | — | 2.76 | 2.1 | — | Yes |
| 20 gram | 0.5 gram | 10 | 2.76 | 2.1 | 0.25 | Partly |
| 20 gram | 1 gram | 10 | 2.76 | 2.1 | 0.5 | Partly |
| 20 gram | 1.5 gram | 20 | 2.76 | 2.1 | 0.75 | Partly |
| 20 gram | 2.0 gram | 55 | 2.76 | 2.1 | 1 | No |

EXAMPLE II

Influence of the Amount of Alkali

In this set of experiments, the influence of the amount of alkali on the solubility of the coating was analysed. As the solubility of boric acid in water glass is limited, additional alkali was used to pre-dissolve the boric acid and to add the resulting solution to the water glass. In the experiments, 2 grams of boric acid were mixed with a certain quantity of alkali hydroxide (as indicated in Tables 2 and 3) in 8 grams of water. The boric acid dissolved. In some cases the resulting borate precipitated again.

The resulting solution or slurry was added to 20 gram of water glass, resulting in a clear solution. The coating solution was applied into the steam chamber of a steam iron and cured at 220° C. Dissolution of the coating was tested at 220° C. with dripping water and verified visually.

In the case of NaOH (Table 2), the solubility started to increase when more then 0.8 grams of NaOH was added. Normalised to the amount of boron this corresponds to a ratio of Si:Na:B=2.76:2.72:1. Lower amounts of Na resulted in insufficient solubility of the boric acid in the amount of water used.

TABLE 2

| Prepared solutions and results | | | | | | | | |
|---|---|---|---|---|---|---|---|---|
| Water glass | Boric acid | NaOH | Si | Na1 | B | Na2 | Na1 + Na2 | Dissolution |
| 20 gram | 2 gram | 0.4 | 2.76 | 2.1 | 1 | 0.33 | 2.43 | No |
| 20 gram | 2 gram | 0.6 | 2.76 | 2.1 | 1 | 0.46 | 2.56 | No |
| 20 gram | 2 gram | 0.8 | 2.76 | 2.1 | 1 | 0.62 | 2.72 | No |

For LiOH (Table 3) similar results were obtained. When adding more than 1 gram of LiOH.H2O, partial dissolution in the dripping test is observed. Normalised to the amount of boron this corresponds to a ratio of Si:(Na+Li):B=2.76:2.84:1. Lower amounts of Li resulted in insufficient solubility of the boric acid in the amount of water used.

TABLE 3

| Prepared solutions and results | | | | | | | | |
|---|---|---|---|---|---|---|---|---|
| Water glass | Boric acid | LiOH | Si | Na | B | Li | Na + Li | Dissolution |
| 20 gram | 2 gram | 0.5 | 2.76 | 2.1 | 1 | 0.37 | 2.47 | No |
| 20 gram | 2 gram | 0.6 | 2.76 | 2.1 | 1 | 0.44 | 2.54 | No |
| 20 gram | 2 gram | 0.8 | 2.76 | 2.1 | 1 | 0.59 | 2.69 | No |
| 20 gram | 2 gram | 1.0 | 2.76 | 2.1 | 1 | 0.74 | 2.84 | No |

For KOH (Table 4) the solubility increased somewhat and less alkali could be added. Adding more than 1 gram of KOH resulted in a coating that partially dissolved in the dripping test. Normalised to the amount of boron this corresponds to a ratio of Si:(Na+K):B=2.76:2.65:1. Lower amounts of K resulted in insufficient solubility of the boric acid in the amount of water used.

TABLE 4

| Prepared solutions and results | | | | | | | | |
|---|---|---|---|---|---|---|---|---|
| Water glass | Boric acid | KOH | Si | Na | B | K | Na + K | Dissolution |
| 20 gram | 2 gram | 0.99 | 2.76 | 2.1 | 1 | 0.54 | 2.65 | No |

The experiments shown here are not exhaustive but indicate that at a given amount of ingredients the practical working range for the alkali to be added increases from K to Li.

EXAMPLE III

Influence of Fillers

A further increase of the mechanical strength can be achieved by filling the borosilicate mixtures with, e.g, silica or alumina. Also other fillers can be employed according to general practice in the coating industry. Addition of fillers is also beneficial to the steaming behaviour of the coating layer as applied. In these experiments, silica particles of fine particle size can be used for instance. They are commercially available from Degussa (Aerosil) or from Grace (Syloid). Alumina particles can be obtained for example from Degussa (e.g Alu-C) or from Baikowski (Baikolox)

In an example, 2 grams of boric acid were dissolved in 8 grams of water with 1.4 grams of KOH. The resulting solution was added to 20 grams of water glass, giving a low-viscosity transparent solution. To this solution was added a dispersion of 2.8 grams of Syloid C809 in 15 grams of water. The resulting slurry was sprayed in a steam chamber of a steam iron. The coating was cured by direct heating of the soleplate to 220° C. The whitish layer gave a good steaming behavior and good adhesion to the aluminum soleplate. Comparable results were obtained when using Alu-C (alumina) from Degussa in the same amounts.

Colloidal silica particles can also be used to advantage. They are commercially available e.g. under the trade name Ludox or Bindzil. The addition of Ludox As40 for instance improves the mechanical strength of the native borosilicate solution.

In another example according to the invention, an amount of 2 grams of boric acid was dispersed in 8 grams of water with 0.5 grams of LiOH.H2O. The mixture was stirred into 20 grams of water glass. After that, 10.8 grams of a silica dispersion from Degussa (Aerodisp 1226, pH 9.5, particle size 0.25 micron) was added to the mixture. The resulting coating composition was sprayed into a soleplate of a steam iron and cured at 220° C. for 2 minutes. Dripping water on the coating resulted in the instantaneous formation of steam, showing that the Leidenfrost temperature was >220° C.

In a further example, 2 grams of boric acid were dispersed in 8 grams of water with 0.5 grams of $LiOH.H_2O$. The mixture was stirred into 20 grams of water glass. After that, a mixture of 7 grams of Ludox AS40 (pH 9.5, 20 nm) and 7 grams of water was added to the mixture. The coating composition thus obtained was sprayed into a soleplate and cured at 220° C. for 2 minutes. Dripping water on the coating resulted in the instantaneous formation of steam, showing that the Leidenfrost temperature was >220° C.

Alternatively, fillers can be dispersed directly into the borate solutions instead of using pre-dispersed fillers.

For example, 2 gr of boric acid was dissolved in 12 gr water with 1.4 gr KOH. Subsequently 2.8 gr Aerosil OX50 was added while stirring, giving a viscous material with a smooth consistency. The resulting material was added to 20 gr of water glass. The coating composition thus obtained was sprayed into a soleplate and cured at 220° C. for 2 minutes. Dripping water on the coating resulted in the instantaneous formation of steam, showing that the Leidenfrost temperature was >220° C.

It is emphasised that the specific amounts of ingredients used in the examples can vary depending on the type of water glass that is used. Commercial grades of water glass can vary in solid content and in the Si/Na ratio.

The coating compositions according to the invention can also be used for system irons having a separate steam chamber connected to the iron by a hose.

The invention relates to a steam generating device comprising a steam chamber provided with a hydrophilic coating. The hydrophilic coating comprises an alkali metal silicate compound and boron, preferably a salt of boron with a metallic element. The coating promotes steaming and is resistant to flaking. The invention also relates to a method of producing the hydrophilic coating in the steam chamber of a steam generating device, and to an iron comprising the steam generating device.

The invention claimed is:

1. A steam generating device comprising:

a steam chamber; and a hydrophilic coating composition located on a surface of the steam chamber, the hydrophilic coating composition comprising an alkali metal silicate compound, boron and a filler, wherein a quantity of the filler is 51% to 60% by weight of the hydrophilic coating composition.

2. The steam generating device according to claim 1, wherein the coating composition further comprises a salt of boron with a metallic element.

3. The steam generating device according to claim 2, wherein the metallic element is an alkali metal element.

4. The steam generating device according to claim 3, wherein the alkali metal element is lithium and/or potassium.

5. The steam generating device according to claim 1, wherein the alkali metal silicate compound comprises a sodium silicate compound.

6. The steam generating device according to claim 2, wherein quantity of the salt of boron with the metallic element is between 1 and 40% by weight of the hydrophilic coating composition.

7. The steam generating device according to claim 1, wherein the hydrophilic coating comprises silica particles.

8. A method of producing a hydrophilic coating in a steam chamber of a steam generating device, the method comprising the acts of:

preparing a mixture of an alkali metal silicate compound and a salt of boron with a metallic element;

introducing the mixture into the steam chamber; and curing the mixture at elevated temperature to form the hydrophilic coating.

9. The method according to claim 8, wherein the mixture is brought to the elevated temperature by heating a surface of the steam chamber.

10. A steam iron comprising a steam generating device according to claim 1.

11. The steam generating device of claim 1, wherein hydrophilic coating composition comprises Si:Na:B in a ratio of 2.76:2.72:1.

12. The steam generating device of claim 1, wherein hydrophilic coating composition comprises Si:(Na+Li):B in a ratio of 2.76:2.84:1.

13. The steam generating device of claim 1, wherein hydrophilic coating composition comprises Si:(Na+K):B in a ratio of 2.76:2.65:1.

* * * * *